US007210521B2

(12) United States Patent
Rauser

(10) Patent No.: US 7,210,521 B2
(45) Date of Patent: May 1, 2007

(54) HEAT MEDIUM DISTRIBUTOR FOR AN AIR INLET SYSTEM INCLUDING MULTIPLE HEAT EXCHANGERS

(75) Inventor: Wolfgang Rauser, Ebhausen (DE)

(73) Assignee: Eisenmann Maschinenbau KG (DE)

( * ) Notice: Subject to any disclaimer, the term of this patent is extended or adjusted under 35 U.S.C. 154(b) by 55 days.

(21) Appl. No.: 10/860,693

(22) Filed: Jun. 3, 2004

(65) Prior Publication Data

US 2005/0006057 A1 Jan. 13, 2005

(30) Foreign Application Priority Data

Jun. 6, 2003 (DE) ..... 103 25 657

(51) Int. Cl.
*F28F 27/02* (2006.01)

(52) U.S. Cl. ..... 165/174; 165/100; 165/83

(58) Field of Classification Search ..... 165/100, 165/174, 178, 83; 137/561 R, 599.14
See application file for complete search history.

(56) References Cited

U.S. PATENT DOCUMENTS

| | | | | |
|---|---|---|---|---|
| 2,082,403 A * | 6/1937 | Larkin | ..... | 165/174 |
| 2,611,584 A * | 9/1952 | Labus | ..... | 165/151 |
| 3,127,200 A * | 3/1964 | Sayag | ..... | 165/177 |
| 4,223,722 A * | 9/1980 | Shade, Jr. | ..... | 165/111 |
| 5,743,111 A * | 4/1998 | Sasaki et al. | ..... | 165/174 |
| 2003/0173069 A1* | 9/2003 | Nitta et al. | ..... | 165/178 |

FOREIGN PATENT DOCUMENTS

| | | | | |
|---|---|---|---|---|
| DE | 4105812 C2 | | 9/1992 | |
| DE | 19628351 C2 | | 1/1998 | |
| GB | 2120745 | | 5/1982 | |
| JP | 60-73216 | * | 4/1985 | ..... 165/83 |

OTHER PUBLICATIONS

Office Action for German Patent Application 103 25 657.1-16 dated Feb. 16, 2004.

* cited by examiner

*Primary Examiner*—Teresa J. Walberg
(74) *Attorney, Agent, or Firm*—Young Basile

(57) ABSTRACT

A heat medium distributor for an air inlet system having multiple heat exchangers includes a box-like housing, which is divided by a dividing wall into a first flow chamber, which is used as the forward collection pipe, and a second flow chamber, which is used as the return collection pipe. For each heat exchanger to be connected, a forward connection nozzle branches off the first flow chamber and for each heat exchanger to be connected, a return connection nozzle opens into the second flow chamber. The arrangement of the connection nozzles is such that all flow paths of the heat medium through the various heat exchangers and the distributor are of equal length. The heat medium distributor replaces traditional heat medium distributors which are produced by welding together individual pieces of pipe, and which are structurally relatively large and therefore expensive, and in general cannot be housed in the housing of the air inlet system.

7 Claims, 4 Drawing Sheets

HEAT MEDIUM DISTRIBUTOR FOR AN AIR INLET SYSTEM INCLUDING MULTIPLE HEAT EXCHANGERS

The invention concerns a heat medium distributor for an air inlet system including multiple heat exchangers, with a) a forward collection pipe for the heat medium, with a forward connection nozzle branching off it for each heat exchanger;

b) a return collection pipe for the heat medium, with a return connection nozzle opening into it for each heat exchanger, where c) the forward and return connection nozzles are arranged so that the flow paths of the heat medium through the distributor are of equal length for all heat exchangers.

In many industrial processes, particularly painting, it is a requirement that the air which is brought into the treatment room should be conditioned, particularly heated. For this purpose, so-called air inlet systems, in which multiple heat exchangers are arranged in parallel to heat the air to be conditioned, are used. A heat medium distributor feeds heated heat medium, in most cases hot water, to the individual heat exchangers, and guides away the heat medium which has been cooled by passing through the heat exchanger.

Known heat medium distributors are produced by soldering or welding individual pieces of pipe to each other. This is associated with expensive manual work, which requires qualified personnel. Also, these known heat medium distributors are structurally relatively large, because all welds must be accessible. The consequence of this large construction is that the heat medium distributor is not normally fitted in the housing of the air inlet system, but must be placed on (not necessarily on top of) it. For this reason, they must be provided with expensive heat insulation.

The object of this invention is to create a heat medium distributor which is of the above-mentioned type, but can be produced more economically and requires less space.

According to the invention, this object is achieved in that d) the heat medium distributor has a box-like housing, which is divided by a dividing wall into a first flow chamber, which is used as the forward collection pipe, and a second flow chamber, which is used as the return collection pipe.

According to the invention, therefore, the heat medium distributor itself no longer consists of pieces of pipe, but essentially is in the form of a box-like housing, which—remotely from the air inlet system on which it is to be fitted—can be produced by largely automatic methods. In this way, the quality of the joins is improved at lower cost. With equally large or even larger flow paths, the box-like housing can be housed in a smaller space than the traditional heat medium distributors. With greater flow cross-sections, the flow rate and flow resistance are reduced, resulting in lower operating costs. The heat medium distributor according to the invention can be fitted in the housing of the air inlet system, and then tested, in the factory, and then transported together with the air inlet system to the end customer, so that the installation time on the end customer's premises is reduced.

Specially preferred is an embodiment of the invention in which the housing is divided by two dividing walls into three flow chambers, of which the first is used as the forward collection pipe and the second and third communicate with each other in one end area, and are used jointly as the return collection pipe. The heat medium which returns from the heat exchangers thus flows through the distributor in one direction, then makes a 180° turn and flows back in the opposite direction. In this way, the connections via which the hot heat medium is fed to the heat medium distributor, and the cooled heat medium is fed away from it, are provided in the same end area of the housing.

It is useful if the housing is put together out of commercially available semi-finished products. As such semi-finished products, flat plates or sheet metal, curved sheet metal or similar can be considered. These must be cut to shape if necessary and then joined to each other. This also reduces considerably the costs which are associated with the production of the heat medium distributor according to the invention.

In particular, the housing can be welded together out of steel parts.

In an advantageous embodiment of the invention, all forward and return connection nozzles are arranged on the same side of the housing, running approximately parallel to the dividing wall. The forward or return connection nozzles pass through the flow chamber which is adjacent to the relevant side of the housing. This heat medium distributor can therefore be arranged, for instance, above the various heat exchangers in the housing of the air inlet system, and can be connected directly to the connections of the individual heat exchangers via its connection nozzles.

Alternatively, it is possible to arrange the forward and return connection nozzles on a side of the housing running approximately perpendicularly to the dividing wall, offset laterally against each other and thus opening directly into the corresponding flow chambers. In this embodiment, it is unnecessary for the connection nozzles to penetrate through a flow chamber, which however in some circumstances makes a somewhat more expensive arrangement of pipes outside the distributor necessary.

The requirement for precision of the welds during production of the heat medium distributor itself, and production and fitting of the heat exchangers, can be reduced if the forward and/or return connection nozzles of the heat medium distributor each include a flexible connector, e.g. a piece of hose. In this way, it is easily possible to compensate for positional divergences of the connection nozzles of the heat medium distributor relative to the connections of the heat exchangers.

As mentioned above, because of the small construction of the heat medium distributor according to the invention, in many cases it is possible to house the heat medium distributor within the housing of the air inlet system. In this case, the housing of the heat medium distributor itself no longer requires thermal insulation, resulting in another significant cost advantage.

An embodiment of the invention is explained in more detail below on the basis of the drawings.

Figure 1:
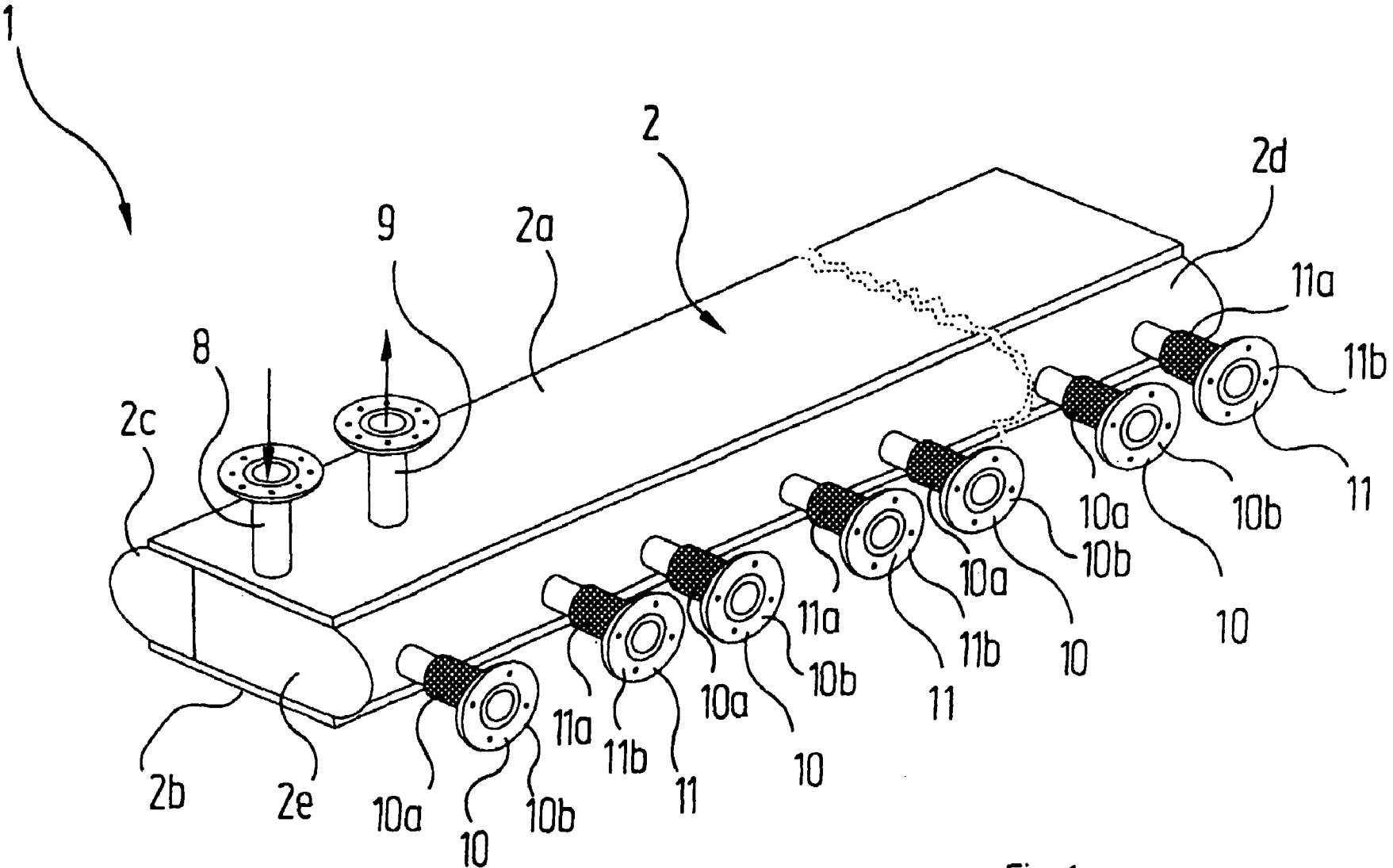
FIG. 1 shows, in isometric representation, a heat medium distributor for an air inlet system.

The heat medium distributor which is shown in the drawings, and which as a whole has the reference symbol 1, is used to feed heat medium, for instance hot water, to multiple heat exchangers. These heat exchangers, which are not shown in the drawings, are in an air inlet system such as is found, for instance, in painting plants, and there conditions, particularly heats, the inlet air for the spray cabin.

The heat medium distributor 1 has a box-shaped housing 2, which essentially is produced from commercially available sheet metal semi-finished products. This housing 2 comprises a rectangular, flat top side 2*a*, a correspondingly shaped rectangular, flat bottom side 2*b*, two curved side walls 2*c* and 2*d* which are semicircular in cross-section, and two correspondingly shaped end walls 2*e* and 2*f*, which can be understood as rectangles with semicircular surface sections placed on their narrow sides.

The housing 2 is divided by two dividing walls 3, 4, which extend perpendicularly to the housing top and bottom sides 2*b* and are tightly joined to them, into a total of three flow chambers 5, 6, 7.

Figure 2:
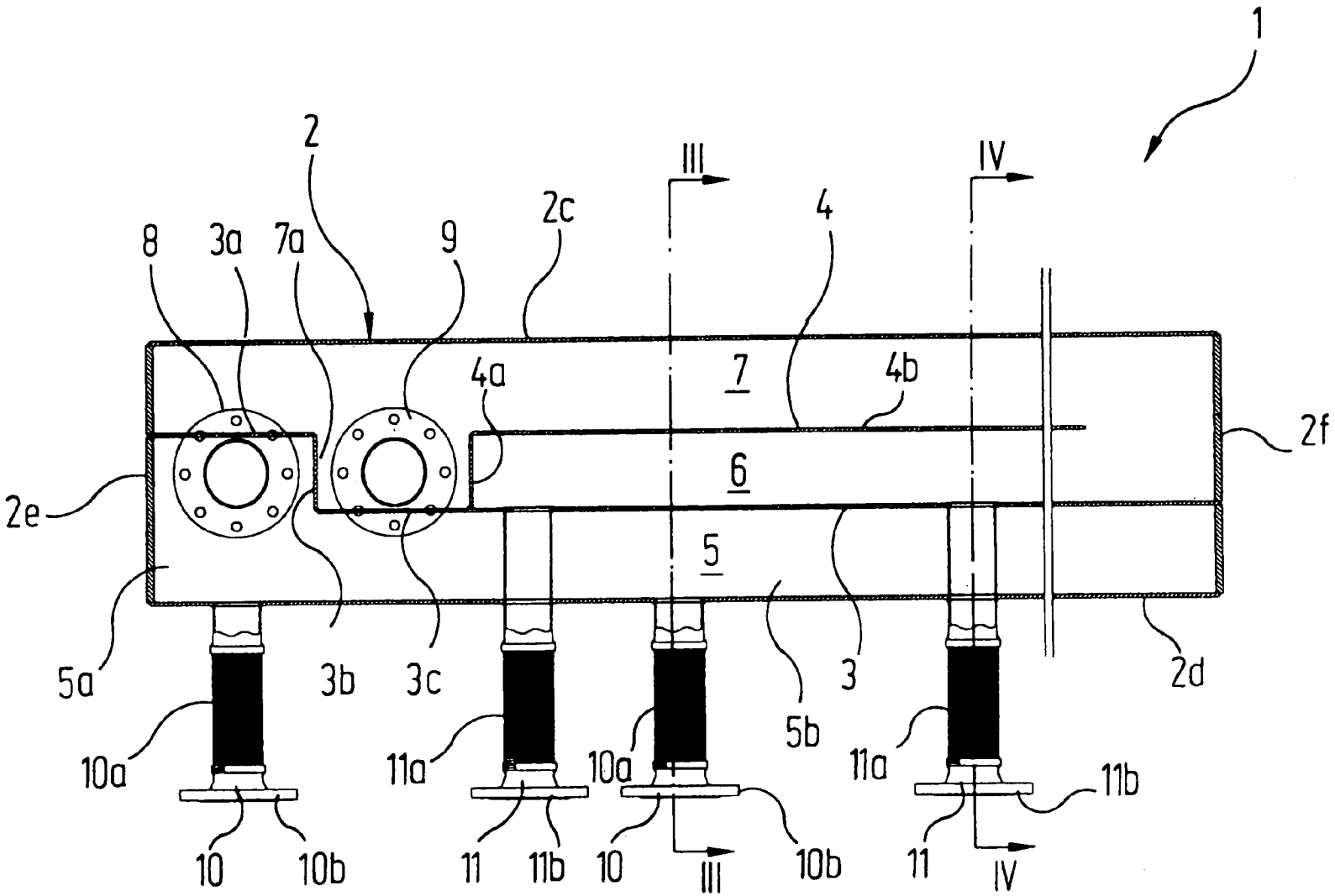
FIG. 2 shows a longitudinal section through the heat medium distributor of FIG. 1.
Figure 3:
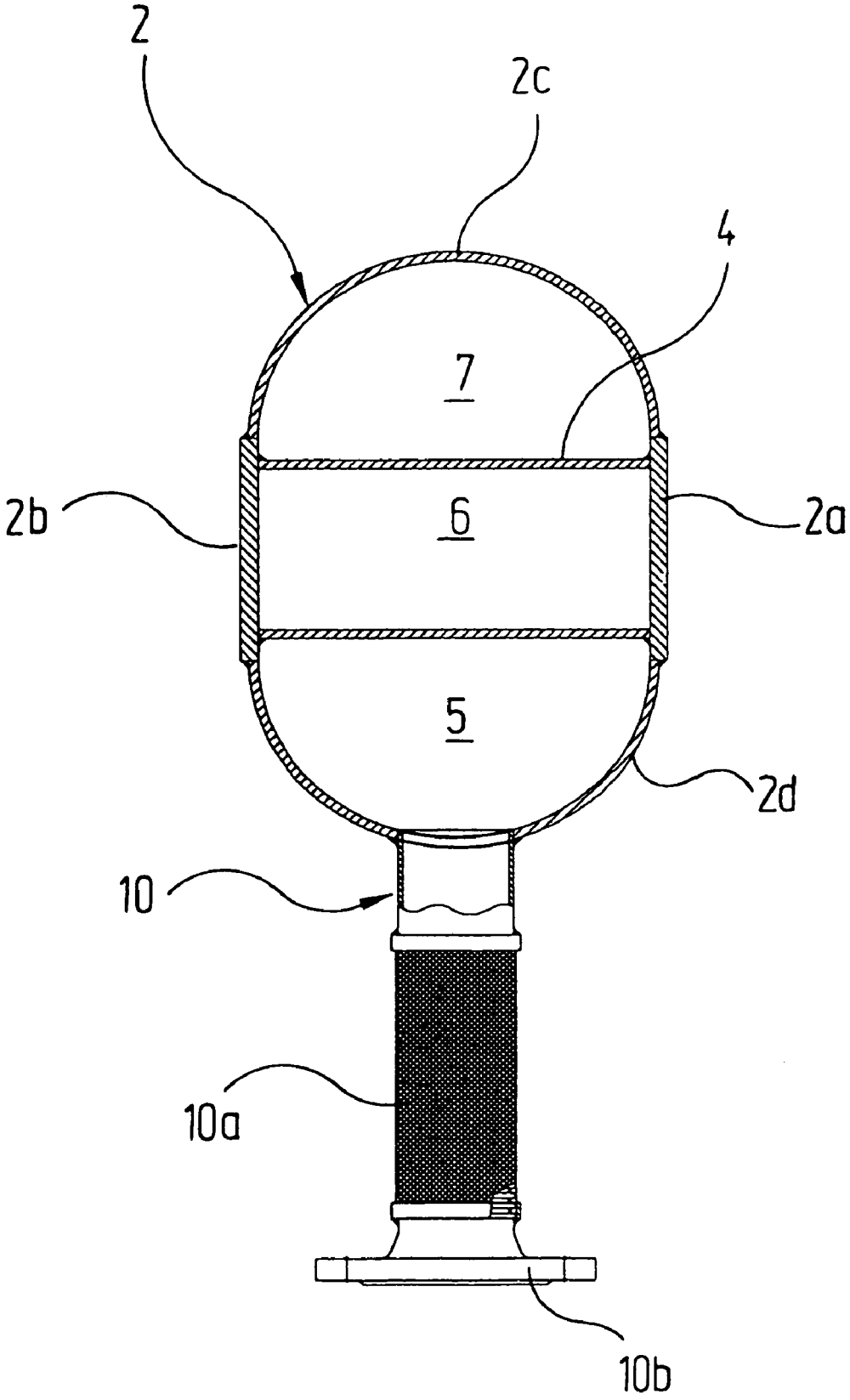
FIG. 3 shows a section according to line III—III of FIG. 2.
Figure 4:
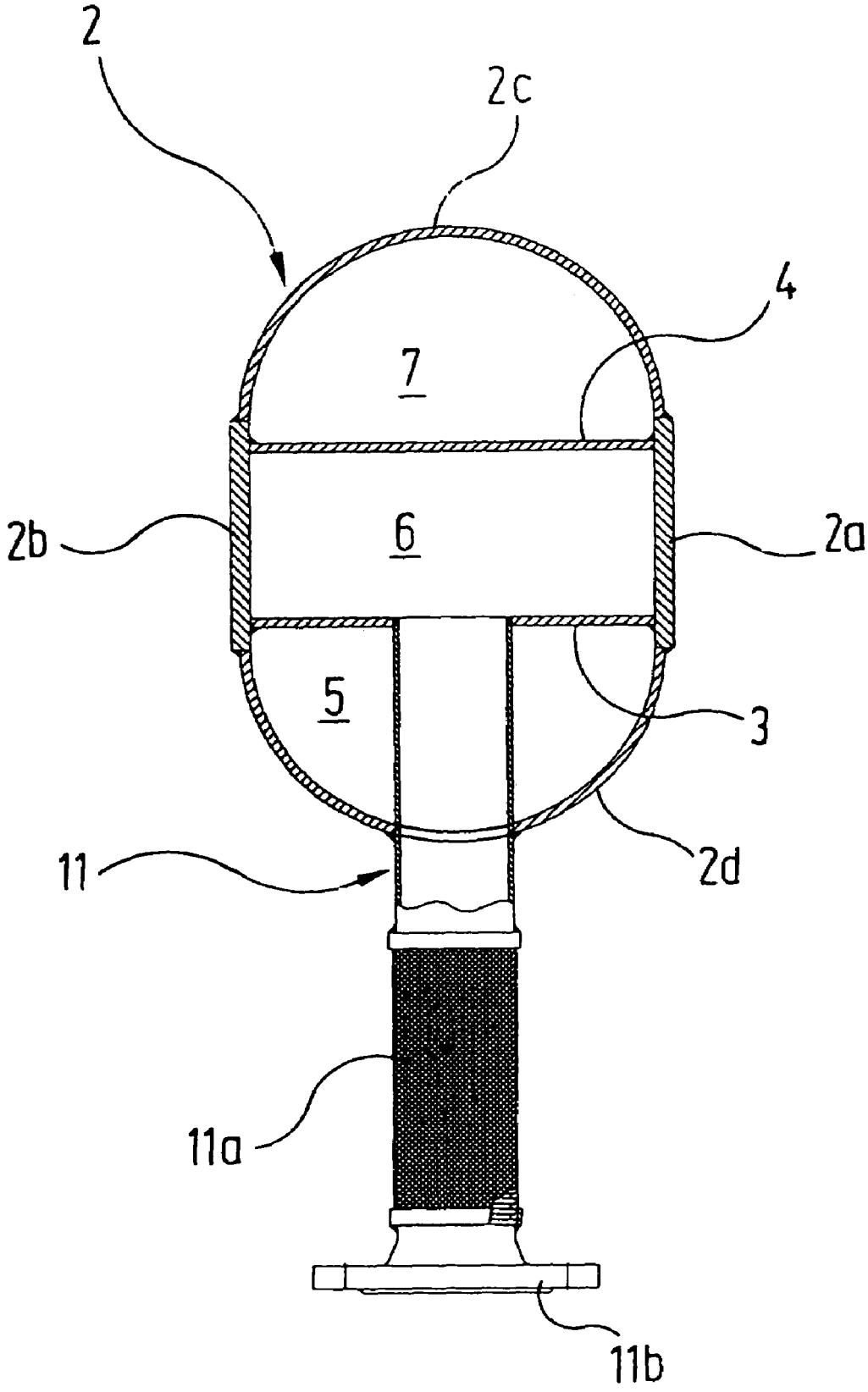
FIG. 4 shows a section according to line IV—IV of FIG. 2.

As shown by, in particular, FIG. 2, the first dividing wall 3 begins on the left-hand end wall 2*e* in FIG. 2, on a line by which the long dimension of the end wall 2*e* is divided in the ratio 1:2. This first dividing wall 3 runs via a relatively short section parallel to the side walls 2*c* and 2*d* of the housing 2, and is then offset in parallel by a wall piece 3*a*, which runs parallel to the end wall 2*e*, by about a third of the width of the housing 2, seen in the direction of the longitudinal extent of the end wall 2*e*. Another dividing wall section 3*c* is put on the dividing wall section 3*b*, and now runs parallel again to the side walls 2*c* and 2*d* and as far as the right-hand end wall 2*f* of the housing in FIG. 2, and is welded to it.

Between the lower side wall 2*b* in FIG. 2 and the first dividing wall 3, a first flow chamber 5 is formed in this way. This is somewhat widened in the area 5*a* which is adjacent to the left-hand end wall 2*e*, compared with the other area 5*b*.

The second dividing wall 4 is put on the dividing wall 3 at a certain distance from the dividing wall section 3*b* and parallel to it, with a section 4*a* which in turn extends by about a third of the longitudinal dimension of the end walls 2*e* and 2*f* in the direction of the upper side wall 2*c* in FIG. 2. On this section 4*a*, a dividing wall section 4*b*, which runs parallel to the side walls 2*c* and 2*d* and ends at a certain distance from the right-hand side wall 2*f* in FIG. 2, is then put.

The internal space of the housing 2, between the first dividing wall 3 and the upper side wall 2*c* in FIG. 2, is thus divided by the second dividing wall 4 into two flow chambers 6, 7, which communicate with each other at the right-hand end of the housing 2 in FIG. 2. The third flow chamber 7, which is adjacent to the upper side wall 2*c* in FIG. 2, is widened in an area 7*a* between the section 3*b* of the first dividing wall 3 and the section 4*a* of the second dividing wall 4*b*.

Into the widened area 5*a* of the first flow chamber 5, an inlet nozzle 8, via which the hot heat medium can be brought into the first flow chamber 5 of the distributor 1, opens from above, i.e. passing through the top side 2*a* of the housing, approximately in the centre of the transverse dimension of the top side 2*a* of the housing. Similarly, into the widened area 7*a* of the third flow chamber 7, a return flow nozzle 9, via which the medium which has flowed through the distributor 1 and the heat exchangers can be guided away, opens from above, passing through the top side 2*a* of the housing.

On the side wall 2*d* of the housing 2, at the bottom of FIG. 2, at regular intervals forward connection nozzles 10, which open into the first flow chamber 5, are attached. Offset against these forward connection nozzles 10 in the longitudinal direction of the housing 2, also at regular, identical intervals, on the lower side wall 2*d* in FIG. 2, return connection nozzles 11 are provided. They pass through the first flow chamber 5 and open into the second flow chamber 6. Each of these connection nozzles 10, 11 includes, outside the housing 2, a flexible piece of hose 10*a* and 11*a* respectively, which is used as a connecting piece, and a connecting flange 10*b* and 11*b* respectively.

All parts of the distributor 1 preferably consist of steel, and are tightly welded at the places where they are joined to each other.

Because of its comparatively small dimensions, the distributor 1 described above can be fitted within the housing of the air inlet system, directly adjacent to the heat exchangers. This has the advantage that the distributor 1, unlike the previously known distributors which were put together out of individual pieces of pipe, and had to be arranged outside the housing of the air inlet system, does not have to be insulated. When the distributor 1 is fitted, the inlet nozzle 8 is connected to the house-side forward pipe of the heat medium, the return flow nozzle 9 is connected to the house-side return pipe of the heat medium, the forward connection nozzles 10 are connected to the corresponding forward connections of the heat exchangers, and finally the return connection nozzles 11 are connected to the return connections of the individual heat exchangers. Because of the flexible hose pieces 10*a*, 11*a*, it is possible to compensate for certain dimensional divergences in the position of the connections of the heat exchangers, so that to this extent it is unnecessary to maintain high welding precision.

In the operation of the air inlet system, hot heat medium flows via the inlet nozzle 8 on the top side 2*a* of the distributor 1 into the first flow chamber 5. It is fed from there via the forward connection nozzles 10 in the lower side surface 2*d* in FIG. 2 to the various heat exchangers, where it partly gives up its heat to the air to be heated. From each heat exchanger, the cooled heat medium returns via a return connection nozzle 11*a* to the distributor 1, where it first flows through the first through-flow chamber 6, then makes a 180° turn at the right-hand end of the housing in FIG. 2, flows through the third flow chamber 7 in the opposite direction, and is finally guided away via the return flow nozzle 9 on the top side 2*a* of the housing 2 to the house-side return pipe.

The arrangement of forward and return connection nozzles 10 and 11 respectively, via which the individual heat exchangers are supplied, corresponds to the Tichelmann principle. This means that the path of the heat medium through the distributor 1 and heat exchangers is of equal length for each individual heat exchanger, so that all heat exchangers are supplied with heat medium in the same way.

The described distributor 1 can be in modular form. This means that at least in its central area it consists of identical sections, in each of which the three described flow chambers 5, 6, 7 are formed and which have a certain number of connection nozzles 10, 11 for heat exchangers. However, the widened areas 5*a*, 7*a* of the flow chambers 5, 7, the inlet nozzle 8 and the return nozzle 9 in the top side 2*a* of the housing, and the connection between the flow chambers 6 and 7, are absent from these central sections of the distributor 1.

In an embodiment of the invention (not shown in the drawings), the third flow chamber 7 is absent. The heat medium is therefore not fed back to near that part of the housing 2 in which the inflow takes place. The inlet nozzle 8 and return nozzle 9 in the top side of the housing 2 are therefore at opposite end areas of the housing 2.

It may be possible to do without the hose pieces 10*a*, 11*a* in the inlet connection nozzles 10 and return connection nozzles 11, if care is taken for high precision in the case of the welds of the distributor 1 and in the fitting of the heat exchangers. Such rigid connection nozzles 10, 11 are obviously more economical.

In the case of the embodiment which is presented above on the basis of the drawings, all connection nozzles 10, 11 for the heat registers are arranged on that side 2*d* of the housing 2 which runs approximately parallel to the dividing wall 3. This makes it necessary that the return connection nozzles 11 penetrate the flow chamber 5 so that they can open into the flow chamber 6. These penetrations are avoided in an embodiment (not shown in the drawings), in which the connection nozzles 10, 11 are arranged on a side of the housing 2 running approximately perpendicularly to the dividing wall, for instance on its bottom side 2*b*. By a certain lateral displacement of the return connection nozzles 11 relative to the forward connection nozzles 10, it is possible for all connection nozzles 10, 11 to open directly into the correct flow chamber 5, 6 in each case.

The invention claimed is:

1. Heat medium distributor for an air inlet system including multiple heat exchangers, comprising:

a) a forward collection pipe for the heat medium, with at least one forward connection nozzle branching off the forward collection pipe for each heat exchanger;

b) a return collection pipe for the heat medium, with at least one return connection nozzle opening into it for each heat exchanger; where c) the forward and return connection nozzles are arranged so that the flow paths of the heat medium through the distributor are of equal length for all heat exchangers, wherein the heat medium distributor it has a box-like housing, which is divided by a dividing wall into a first flow chamber, which is used as the forward collection pipe, and a second flow chamber, which is used as the return collection pipe wherein the housing is divided by two divided walls into three flow chambers, of which the first flow chamber is used as the forward collection pipe and the second and third flow chambers communicate with each other in one end area, and are used jointly as the return collection pipe.

2. Heat medium distributor according to claim 1 wherein the housing is put together out of commercially available semi-finished products.

3. Heat medium distributor according to claim 1 wherein the housing is welded together out of steel parts.

4. Heat medium distributor according to claim 1 wherein all the at least one forward connection nozzle and the at least one return connection nozzle are arranged on the same side of the housing, running approximately parallel to the dividing wall, and that the at least one forward connection nozzle or the at least one return connection nozzle passes through the flow chamber which is adjacent to the relevant side of the housing.

5. Heat medium distributor according to claim 1, wherein all the at least one forward and the at least one return connection nozzles are arranged on a side of the housing running approximately perpendicularly to the dividing wall, offset laterally against each other and thus opening directly into the corresponding flow chambers.

6. Heat medium distributor according to claim 1, wherein at least one of the forward connection and return connection nozzles includes a flexible piece of hose.

7. Heat medium distributor according to claim 1 wherein the housing has no thermal insulation.

* * * * *

UNITED STATES PATENT AND TRADEMARK OFFICE

CERTIFICATE OF CORRECTION

PATENT NO. : 7,210,521 B2
APPLICATION NO. : 10/860693
DATED : May 1, 2007
INVENTOR(S) : Wolfgang Rauser It is certified that error appears in the above-identified patent and that said Letters Patent is hereby corrected as shown below:

Column 3, line 19, “3a” should read --3b--.

Column 5, line 31, “distributor it has” should read --distributor has--.

Signed and Sealed this

Seventh Day of August, 2007

JON W. DUDAS
*Director of the United States Patent and Trademark Office*